US009312051B2

(12) United States Patent
Lorenz et al.

(10) Patent No.: US 9,312,051 B2
(45) Date of Patent: Apr. 12, 2016

(54) COAXIAL CONDUCTOR STRUCTURE

(75) Inventors: Martin Lorenz, Mittenwald (DE); Kai Numssen, Höhenkirchen-Siegertsbrunn (DE); Christoph Neumaier, Baiern (DE); Natalie Spaeth, Rosenheim (DE)

(73) Assignee: Spinner GmbH, Westerham (DE)

( * ) Notice: Subject to any disclaimer, the term of this patent is extended or adjusted under 35 U.S.C. 154(b) by 59 days.

(21) Appl. No.: 13/809,901

(22) PCT Filed: Jul. 11, 2011

(86) PCT No.: PCT/EP2011/003469

§ 371 (c)(1),
(2), (4) Date: Jan. 14, 2013

(87) PCT Pub. No.: WO2012/007148

PCT Pub. Date: Jan. 19, 2012

(65) Prior Publication Data

US 2013/0112477 A1 May 9, 2013

(30) Foreign Application Priority Data

Jul. 15, 2010 (DE) ..... 10 2010 027 251

(51) Int. Cl.
*H01B 11/18* (2006.01)
*H01P 1/202* (2006.01)

(52) U.S. Cl.
CPC ..... *H01B 11/1808* (2013.01); *H01P 1/202* (2013.01)

(58) Field of Classification Search
USPC ..... 174/28, 117 F, 117 FF
See application file for complete search history.

(56) References Cited

U.S. PATENT DOCUMENTS 2,253,503 A * 8/1941 Bowen ..... 331/77
2,851,666 A * 9/1958 Kach ..... 333/207

(Continued)

FOREIGN PATENT DOCUMENTS

CA 2 622 456 4/2007
DE 1 263 943 3/1966

(Continued)

OTHER PUBLICATIONS

Konoplev, I.V. et al: "Wave Interference and Band Gap Control in Multiconductor One-Dimensional Bragg Structures," Journal of Applied Physics, vol. 97, No. 7, S. 073101-073101-7, Apr. 2005, DOI 10.1063/1.1863425, 7 pgs.

(Continued)

*Primary Examiner* — Tremesha S Willis
*Assistant Examiner* — Michael E Moats, Jr.
(74) *Attorney, Agent, or Firm* — Fitch, Even, Tabin & Flannery LLP

(57) ABSTRACT

The invention is a coaxial conductor structure for fault-free transmission of a TEM Mode of a HF signal wave within at least one band of frequency bands forming in the context of a dispersion relation. An inner conductor and an outer conductor are spaced radially apart from the inner conductor and an axially extending common conductor section of the inner and the outer conductor. A number n of electrically conductive ring-shaped structures are each fitted between the inner and outer conductor to be radially spaced apart, each of which have an electrical path completely surrounding the inner conductor and are arranged with a spatially periodic sequence with an equal distance between the two ring-shaped structures which are adjacent along the conductor section.

9 Claims, 6 Drawing Sheets

(56) References Cited

U.S. PATENT DOCUMENTS

| | | | | | |
|---|---|---|---|---|---|
| 3,144,624 | A | * | 8/1964 | Rypinski, Jr. | H01P 1/202 333/206 |
| 3,400,298 | A | * | 9/1968 | Krahn | 315/3.5 |
| 3,421,122 | A | * | 1/1969 | Yukio et al. | 333/235 |
| 3,518,583 | A | * | 6/1970 | Yukio et al. | 333/206 |
| 3,646,581 | A | * | 2/1972 | Grace | 330/287 |
| 3,673,510 | A | * | 6/1972 | Grace et al. | 330/287 |
| 3,873,948 | A | * | 3/1975 | Lammers et al. | 333/206 |
| 3,967,217 | A | * | 6/1976 | Solomon | 332/105 |
| 4,004,257 | A | * | 1/1977 | Geissler | 333/207 |
| 4,066,988 | A | * | 1/1978 | Karp | 333/223 |
| 4,161,704 | A | * | 7/1979 | Schafer | 333/33 |
| 4,175,257 | A | * | 11/1979 | Smith et al. | 330/287 |
| 4,216,449 | A | * | 8/1980 | Kach | 333/236 |
| 4,223,287 | A | * | 9/1980 | Nishikawa et al. | 333/206 |
| 4,422,012 | A | * | 12/1983 | Kosmahl | 315/3.5 |
| 4,636,759 | A | | 1/1987 | Ishikawa et al. | |
| 4,751,464 | A | * | 6/1988 | Bridges | 324/318 |
| 4,981,445 | A | * | 1/1991 | Bacher et al. | 439/578 |
| 5,280,256 | A | * | 1/1994 | Tan | 333/167 |
| 5,594,342 | A | * | 1/1997 | Brey et al. | 324/322 |
| 6,255,920 | B1 | | 7/2001 | Ohwada et al. | |
| 6,567,057 | B1 | | 5/2003 | Sievenpiper et al. | |
| 2003/0184407 | A1 | * | 10/2003 | Tsunoda et al. | 333/110 |
| 2005/0040918 | A1 | | 2/2005 | Kildal | |
| 2005/0190018 | A1 | | 9/2005 | Kawai et al. | |

FOREIGN PATENT DOCUMENTS

| | | | | | |
|---|---|---|---|---|---|
| DE | 1263943 | | * | 3/1968 | H01P 1/202 |
| EP | 1 053 336 | A1 | | 12/2000 | |
| EP | 1058336 | | * | 12/2000 | H01P 1/202 |
| EP | 1058336 | A1 | * | 12/2000 | H01P 1/202 |
| EP | 1 562 258 | A1 | | 8/2005 | |
| FR | 944576 | | | 4/1948 | |

OTHER PUBLICATIONS

Mode, Douglas E.: "Coaxial Transmission-Line Filters", Proceedings of the IRE, IEEE, Piscataway, NJ, US, Bd. 39, Nr. 12, Dec. 1, 1952, pp. 1706-1711, XP011153549, ISSN: 0096-8390.

* cited by examiner

COAXIAL CONDUCTOR STRUCTURE

BACKGROUND OF THE INVENTION

1. Field of the Invention

The invention relates to a coaxial conductor structure for fault-free transmission of a TEM basic mode of a RF signal wave.

2. Description of the Prior Art

The transmission quality of coaxial conductors for the TEM basic mode of RF signal waves decreases for increasing signal frequencies, given the fact that undesirable higher-order modes are able to propagate for higher frequencies, for example $TE_{11}$, $TE_{21}$ modes etc., which by way of mode conversion processes may be excited at interference locations and then come to overlay the TEM basic mode.

In particular with regard to future expansions of, or changes to, existing transmission ranges to incorporate higher frequencies for RF signals, which have been specified in the frequency usage plan for the Federal German Republic, it is important to look for ways of permitting an essentially fault-free high-frequency signal transmission of the TEM basic mode of RF signals via coaxial lines of a maximum possible diameter, so as to enable maximum possible transmission output for a minimum of losses.

In a contribution by Konoplev, I. V. et al; "Wave Interference and Band Gap Control in Multi-Conductor One-Dimensional Bragg Structures", Journal of Applied Physics, vol. 97, Nr. 7, p. 073101-073101-7, April 2005, DOI: 10.1063/1, 1863425, a one-dimensional coaxial Bragg structure has been described, which is intended to selectively influence the propagation behavior of electro-magnetic waves by way of constructive and destructive interferences. To this end the coaxial waveguide structure is provided with a periodical structure of groove-like depressions on its inner and outer conductor walls, the geometric design of which impacts in different ways upon the reflection behavior of RF waves which pass through the corrugated coaxial conductor structure.

SUMMARY OF THE INVENTION

The coaxial conductor structure according to the invention is based on the knowledge that the transmission behavior of coaxial conductors for RF signal waves changes significantly if electrically conducting ring-shaped structures, "ring structures" for short, are fitted between the inner and outer conductor at respectively equidistant distances, which structures provide a completely surrounding current path, that is a current path closed in the ring circumferential direction. The ring-shaped structures are designed as separate structures and are disposed each so as to be radially spaced apart to both the inner and the outer conductor.

When observing the propagation behavior of the TEM basic mode along a conventional coaxial line, that is outer and inner conductors are electrically insulated by an intermediate dielectric. In terms of a dispersion diagram, there is a linear correlation which exists between the frequency f or circular frequency ω, and the propagation constant β of the RF signal wave of the form $e^{j(ax-\beta x)}$, that is ω=c(β). This linear correlation is represented in a dispersion diagram ω(β). See FIG. 2*a*, as a so-called speed-of-light straight (TEM). As from a lower critical frequency, the so-called cut-off frequency ($f_{co}$) for the $TE_{11}$ mode, undesirable higher-order propagation modes such as $TE_{11}$, $TE_{21}$, $TE_{31}$, $TE_{41}$, $TE_{01}$, $TE_{11}$ etc. form along the conventional coaxial conductor for increasing frequencies, resulting in the TEM basic mode being always overlaid by modes of a higher-excitation order for frequencies above $f_{co}$.

If on the other hand, according to the representations in FIG. 1*a, b*, electrically conducting, radially-spaced-apart ring structures R are provided between the outer conductor AL and the inner conductor IL of the coaxial line, this impacts upon the propagation modes shown in FIG. 2*a* for the $TE_{11}$ and $TE_{21}$ modes in the manner shown in FIG. 2*b*. Due to the regular insertion of rings along the coaxial conductor structure a periodicity of length p (see FIG. 1*b*) is created. As a result, ω(β) is no longer observed in dispersion diagrams, as in the case of FIG. 2*a*, but ω(Φ), wherein Φ=βp is the phase difference of the respective wave along an elementary cell of length p. In contrast to the situation in FIG. 1*a*, where, as frequencies increase, the $TE_{11}$ mode moulds itself to the speed-of-light straight (TEM). The propagation behavior of the $TE_{11}$ mode in FIG. 2*b* flattens remarkably, and for higher frequencies is limited by an upper cut-off frequency $f_{co,upper}$.

When looking more closely at the dispersion diagram, it can be recognized that according to the invention two propagation channels form along the coaxial line shaped according to the invention for the respective propagation modes. These channels are an inner propagation channel (ic=inner core) between the inner conductor IL and the rings R, and an outer propagation channel (oc=outer core) between the rings R and the outer conductor (AL). For a suitable geometry choice for the coaxial conductor containing the ring structures, a frequency band window Δf forms between the $TE_{11,ic}$ mode propagating along the inner propagation channel and the $TE_{21,oc}$ and $TE_{11,oc}$ modes propagating along the outer propagation channel. The result is that on the one hand, the $TE_{11}$ mode for lower frequencies propagates in the outer propagation channel, that is representing a $TE_{11,oc}$ mode, and for higher frequencies flattens, and that on the other hand, for higher frequencies, a propagatable $TE_{11,ic}$ mode and a propagatable $TE_{21,oc}$ mode form both along the inner propagation channel and along the outer propagation channel.

This flattening of the $TE_{11,oc}$ mode causes the frequency band window Δf to form, which towards higher frequencies is capped by the lower of the two lower cut-off frequencies $f_{co,lower}$ of the $TE_{21,oc}$ mode or the $TE_{11,ic}$ mode, and in which the TEM mode is able to propagate without interference, that is without being adversely affected by interfering higher modes.

Using the measure according to the invention, and given a suitable design for the ring parameters and coaxial parameters, a frequency band window may be created and utilized for example between approx. 6.8 GHz and 10.6 GHz for an interference-free propagation of the TEM mode. This knowledge can be derived by performing theoretical tests on an elementary cell which comprises a ring disposed between the inner and outer conductor and repeats with the periodicity p in longitudinal direction of the coaxial conductor structure on the basis of the Bloch Floquet theorem in conjunction with periodic marginal conditions. As such the upper and lower cut-off frequencies can be determined as a function of geometrical sizes by which the coaxial conductor structure can be characterized.

The upper cut-off frequency $f_{co,lower}$ of the frequency window can be determined approximately by the two lower cut-off frequencies $f_{co,TE21,oc}$ of the $TE_{21,oc}$ mode or the $TE_{11,ic}$ mode $f_{co,TE11,ic}$, depending on which of the two modes has a smaller lower cut-off frequency, using the following equation:

$$f_{co,lower} = \min\left(f_{co,TE21,oc} \approx \frac{4c}{\pi(d_4+d_3)};\ f_{co,TE11,ic} \approx \frac{2c}{\pi(d_2+d_1)}\right),$$

wherein:

c:=speed of light $d_1$:=diameter of inner conductor $d_2$:=inner diameter of ring $d_3$:=outer diameter of ring $d_4$:=diameter of outer conductor with $d_1<d_2<d_3<d_4$ The lower frequency $f_{co,upper}$ of the frequency window can, however, be characterized by the ring resonance frequency $f_{co,TE11ring}$ in the following manner:

$$f_{co,RE11ring} \approx \frac{2c}{\pi(d_3+d_2)}$$

Further a closer look at the dispersion diagram shown in FIG. 2*b*, relating to the propagation behavior of the TEM mode, shows that it flattens for higher frequencies at which the TEM mode is again subject to an upper cut-off frequency $f_{co,TEM}$ for which approximately $$f_{co,TEM} \approx c/2p$$

In the above approximation c is the speed of light and p is the axial length of an elementary cell, see also FIG. 1*a*. In order to ensure that the TEM mode can propagate freely within the discussed frequency band window Δf, the following requirement must be met: $f_{co,lower}<f_{co,TEM}<f_{co,lower}$. For $f_{co,lower}$, depending upon the position of the lower cut-off frequency of the $TE_{21}$ mode or $TE_{11}$ mode being formed, the respectively lower cut-off frequency must be selected.

On the basis of this knowledge according to the invention a plurality of tests has been carried out in order to check the robustness of the above-discussed effect. That is the targeted creation of band gaps in which an interference-free propagation of the TEM mode becomes possible. The following embodiments show possibilities, where an interference-free propagation of the TEM mode can be observed within a frequency window Δf forming due to the measure according to the invention and where in addition a targeted influence can be exerted upon the propagation behavior of the modes involved.

Using the design of a coaxial conductor according to the invention and given a suitable design and geometry choice of the ring-shaped structures fitted between the inner and outer conductor of the coaxial line, a low-pass filter function for RF signals can be realized in that the ring-shaped structures are respectively connected with the outer conductor via at least one electrical connecting web, preferably via two, three or more electrical connecting webs, wherein the electrically conducting connecting webs, where providing two or more connecting webs, are evenly distributed in the circumferential direction along the ring-shaped structures between these and the outer conductor. The connecting webs form local electrical connections between the ring structures and the outer conductor and represent local inductivities, so-called shunt inductivities. Again, this results in varying propagation behaviors for the inner and outer propagation channels, as described above, but now for the propagation behavior of the TEM mode. By way of theoretical tests on an elementary cell which comprises a ring arranged between the inner and outer conductor, which is connected with the outer conductor via at least one electrically conducting connecting, web called a "spoke" in the following, and which cell repeats with the periodicity p in longitudinal direction of the coaxial conductor structure, a band gap can be ascertained on the basis of the Bloch-Floquet theorem in conjunction with periodic marginal conditions, in which the TEM mode is not able to propagate. This band gap is limited by an upper $f_o$ and a lower $f_u$ cut-off frequency, which can be determined as a function of geometric sizes of the coaxial conductor structure in the following manner:

$$f_0 = f_{min}\begin{pmatrix} f_{TEM,oc} \approx \dfrac{1}{2\pi\sqrt{C_{oc}L_{shunt}}}; \\ f_{TEM,mix} \approx \dfrac{c}{2p}; \\ f_{TE11,ic} = \dfrac{2c}{\pi(d_2+d_1)} \end{pmatrix};$$

$$f_u \approx \frac{1}{2\pi\sqrt{(C_{ic}+C_{oc})L_{shunt}}}$$

with $$L_{shunt} = 0.946\frac{\mu}{2\pi}l\left[\ln\left(0.5935\frac{d_4}{r} - 0.6225\frac{l}{r}\right) - 0.1336\right]$$

assuming only one spoke between ring and outer conductor; for two or more spokes similar empirical formulae can be developed;

$$C_{ic} = \frac{2\pi\varepsilon p}{\ln\frac{d_2}{d_1}}$$

$$C_{oc} = \frac{2\pi\varepsilon p}{\ln\frac{d_4}{d_3}}$$

$L_{shunt}$: Overall inductivity of the electrically conducting connecting webs, so-called spokes, $C_{ic}$: capacity between ring and inner conductor, $C_{oc}$: capacity between ring and outer conductor, c: speed of light, μ: permeability, ∈: permittivity, p: cell length, a: distance between rings l: spoke length [for AL ring spokes l=(d4−d3)/2], r: an effective spoke radius, $d_1<d_2<d_3<d_4$ see above.

Typically the upper cut-off frequency $f_o$ of the band gap can be determined approximately by three lower cut-off frequencies, depending upon which of the three cut-off frequencies has the smallest value, that is $f_{TEM,oc}$ for the TEM mode capable of propagating in longitudinal direction of the outer propagation channel, $f_{TE11,ic}$ for the $TE_{11,ic}$ mode capable of propagating in longitudinal direction of the inner propagation channel, and $f_{TEM,mix}$ for the TEM mode capable of propagating in both propagation channels with respectively anti-parallel E field orientations.

A further preferred embodiment of the coaxial conductor structure provides for the use of ring structures between inner and outer conductor which can be divided into two groups as regards their shape and/or size, wherein structurally identical ring structures are contained in each group.

The arrangement of the ring structures along the coaxial conductor is chosen such that the group affiliation of the ring structures alternates bi-periodically with axial sequence between inner and outer conductor. Due to this measure the transmission quality of RF signals along the coaxial conductor structure can be significantly improved.

BRIEF DESCRIPTION OF THE DRAWINGS

The invention will now be described, without limiting the general inventive idea in any way, by way of exemplary embodiments with reference to the drawings, in which.

DETAILED DESCRIPTION OF THE INVENTION

Figure 3:
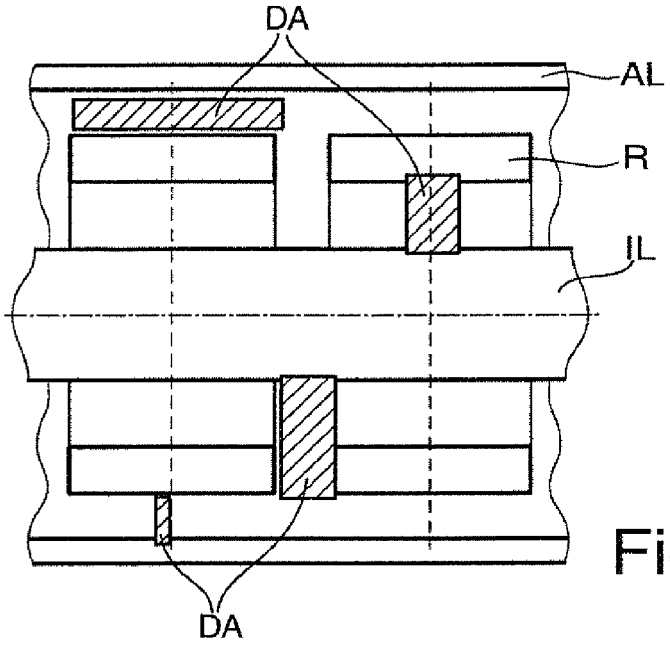
FIG. 3 is a longitudinal section through a coaxial conductor structure with fixings for the ring structures.

A first embodiment of the invention provides for the periodic arrangement of n, which is greater three individual rings R along the coaxial conductors. See FIGS. 1*a* and *b*, wherein the axial distance between two adjacent rings R is chosen to be equal. The rings R are an electrically conducting material having a radial and an axial extension, wherein the ring width, that is its axial extension, is greater than the ring thickness, its radial extension. The electrically conducting rings are ideally fitted to be free-floating between the inner conductor IL and the outer conductor AL of the coaxial line, so that each ring R is able to maintain an arbitrary constant potential. For technical realization individual rings R are supported and fixed within the coaxial line between inner and outer conductor by means of dielectric spacers DA (see FIG. 3) in the form of rings, inserts, posts, spokes etc.

Figure 4:
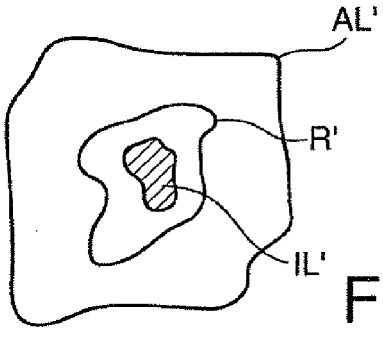
FIG. 4 is a schematic cross-section through a modified coaxial conductor structure.

As a variation from classically designed rings R, the effect according to the invention can be observed also in coaxial conductor structures which comprise an inner conductor IL' and an outer conductor AL' which in turn deviate from the classical circular coaxial geometry. An arrangement of this kind is schematically shown in FIG. 4, which shows an inner conductor IL' and an outer conductor AL' with respectively a randomly chosen conductor cross-section, between which a contactless ring-shaped structure R' is fitted, again with a random ring structure. The essential requirement which must be fulfilled, apart from the arrangement of the ring-shaped structures R' periodically repeating in axial direction, relates to the completely enclosed current path about the internal inner conductor IL' along each individual ring-shaped structure R'. This requirement also applies to all other embodiments, including those according to FIG. 1.

Figure 1A:
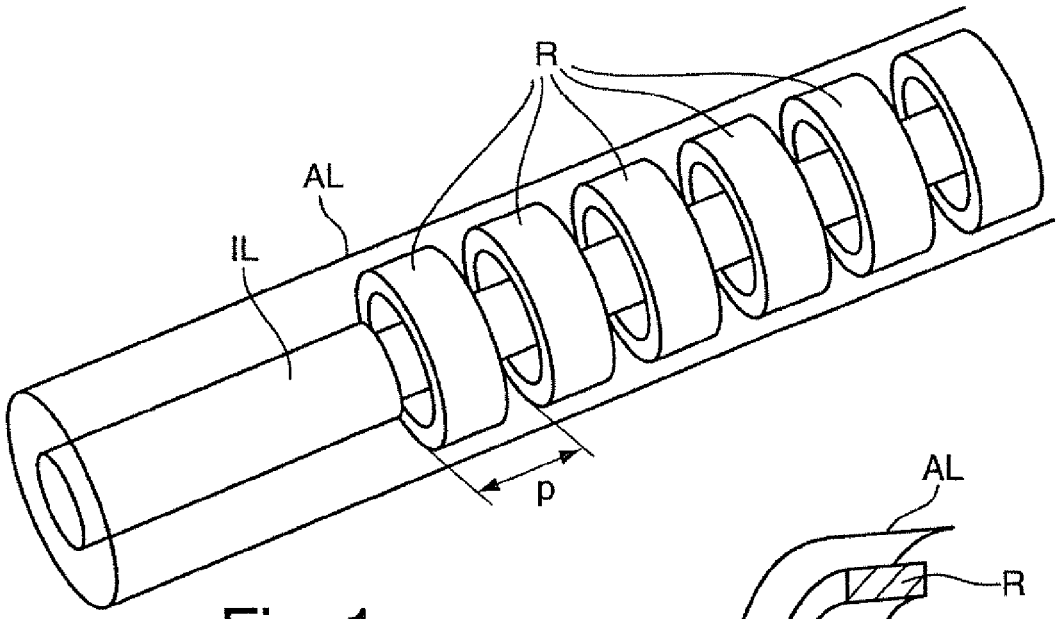
FIGS. 1*a* and *b* are respectively a longitudinal section through a coaxial conductor structure with a ring structure and perspective view of a coaxial conductor structure with a plurality of rings disposed between inner and outer conductor.
Figure 1B:
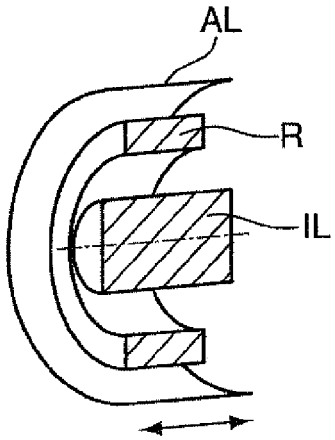
Figure 5A:
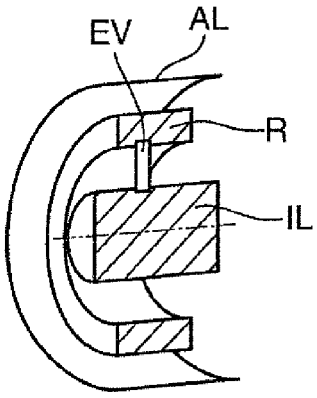
FIGS. 5*a, b* and *c* respectively show sequential sections through a coaxial conductor structure with electrical connections between an inner conductor, a ring structure and an outer conductor.
Figure 5B:
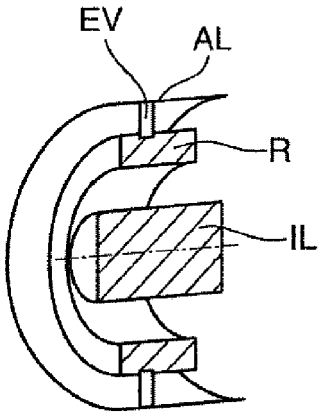
Figure 5C:
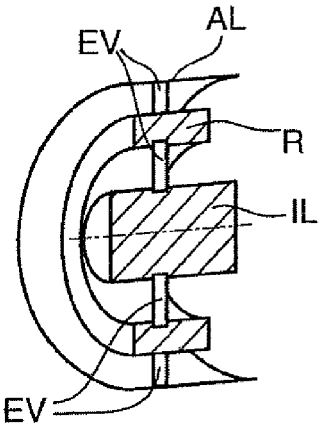

A further embodiment is based on the ring arrangement according to the embodiment illustrated in FIGS. 1*a* and *b*, and respectively provides for at least one local electrical connection EV between the inner conductor IL and the rings R as shown in FIG. 5*a* between the rings R and the outer conductor AL, as shown in FIG. 5*b*, or between both the inner conductor IL and the rings R and between the rings R and the outer conductor AL as shown in FIG. 5*c*. The electrical connections EV are preferably designed as pin-like metallic conductor structures and due to their heat-conducting properties, serve as local cooling bridges between individual components. The electrical connecting points for all rings R are arranged in axial sequence, are arranged in identical positions and identically aligned or are arranged in axial ring sequence rotated by a specifiable amount in ring circumferential direction, preferably by respectively 90° or 180°, from ring to ring.

Figure 6:
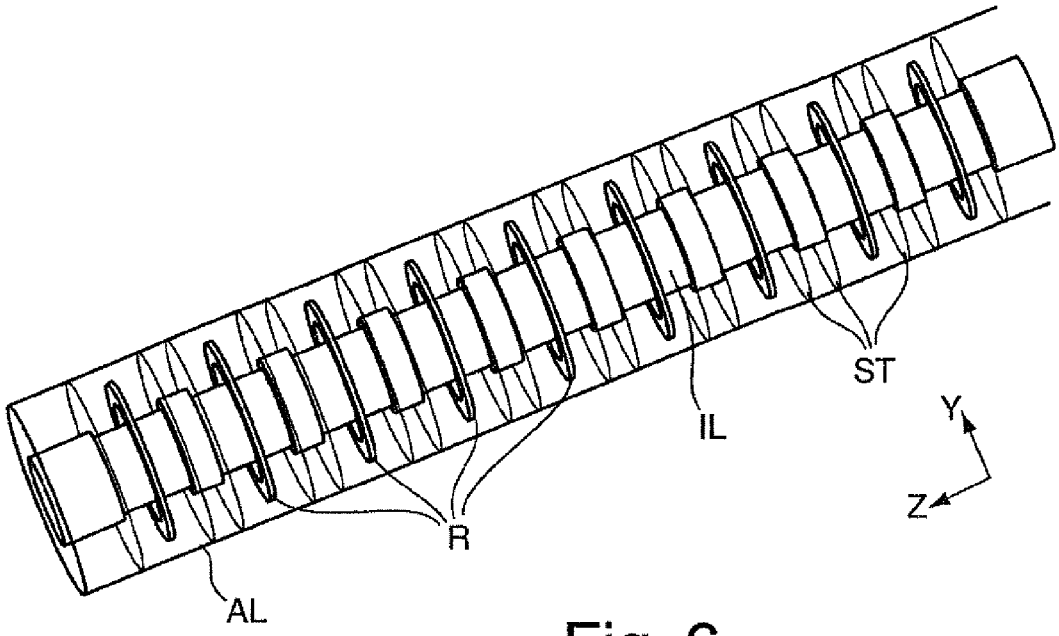
FIG. 6 is a disc-like design of the ring structure.

FIG. 6 shows an embodiment with ring-type structures R shaped as discs with the axial extension being small compared to the disc's radial extension. The inner conductor IL illustrated here comprises diameter jumps in longitudinal direction, that is in the area of each ring structure R the diameter of the inner conductor IL is reduced compared to the inner conductor section located between two ring structures R, as shown in FIG. 6. Such jumps in the radius of the inner conductor IL contribute to an improved adaptation for RF signal transmission. Similarly, it is feasible to provide corresponding jumps (not shown) in the inner cross-section on outer conductor AL. Coaxial centering of the inner and outer conductors is affected by dielectric spacer discs ST fitted between two ring structures.

Figure 7:
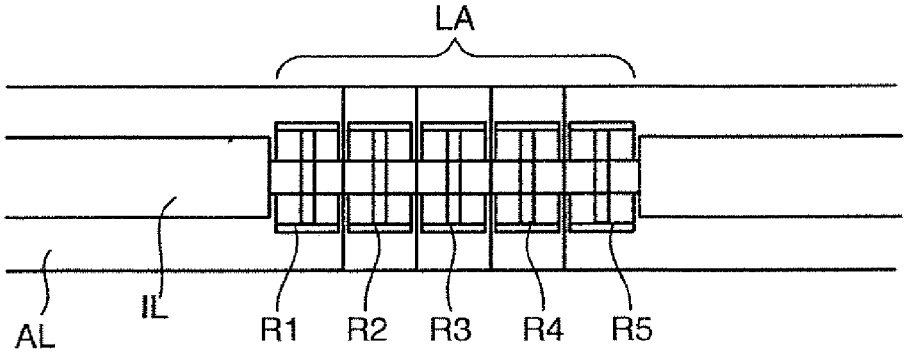
FIG. 7 is a low-pass filter arrangement.

FIG. 7 shows an embodiment for a coaxial conductor structure shaped according to the invention with a common conductor section LA of inner conductor IL and outer conductor AL, along which a number (n=5) of electrically conducting ring-shaped structures R1 to R5 which have been fitted respectively radially between inner conductor IL and outer conductor AL, which respectively comprise an electrical path completely surrounding the inner conductor IL. The ring structures R1 to R5 are arranged with a spatially periodic sequence with respectively an equidistant distance between two ring structures which are adjacent along the conductor section LA. In the illustrated case, the inner conductor IL of the coaxial line comprises a larger diameter in areas without ring structures than in the above-described common conductor section LA along which the ring structures R1 to R5 have been arranged. The individual ring structures R1 to R5 are supported here via two electrically conducting connecting structures, so-called spokes, respectively and are connected with the inner conductor IL. An arrangement of this kind comprises the properties discussed in the beginning with regard to an interference-free propagation of the TEM mode within a frequency window for high frequencies and in addition comprises filter properties with a high slope steepness, for example in the form of a band rejection filter or low-pass filter. The high slope steepness is connected with the forming of transmission zero spots in the rejection range, which arise as a result of the interaction between spoke inductivity and intermediate ring capacity CL. For an improved adaptation at the input and output of the conductor section LA capable of acting as a filter, that is for the purpose of a reduction in reflections in the area of the first and last ring structures R1 and R5, their design has been modified compared to the otherwise identical ring structures R2, R3 and R4. For example, ring structures R1 and R5 comprise a smaller ring diameter. It is, of course, possible to devise other adaptation measures for the ring structures R1 and R5 serving as adaptation links, for example by choosing a special material, a special ring width, and/or ring thickness etc.

Figure 8:
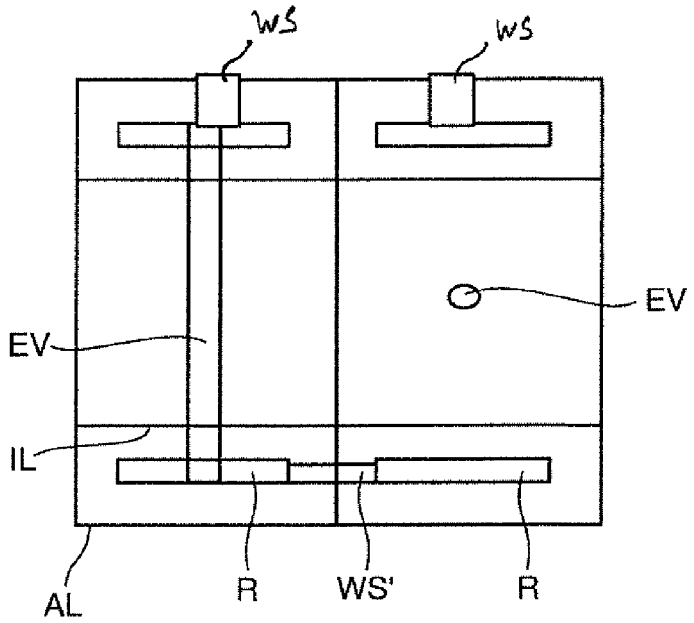
FIG. 8 is a longitudinal section through a coaxial conductor structure with 1-way switching elements.

In a further embodiment shown in FIG. 8 the dispersion properties of a coaxial conductor structure shaped according to the invention are influenced by utilizing switchable components WS, for example in the form of PIN diodes or varactors. Let it be assumed that a switchable component WS has been fitted, respectively, between ring structures R and outer diameter AL, which component can be placed into a conducting state or a blocking state depending on the voltage applied to it. This makes it possible to have a short-circuit or an idle state between the ring structures R and the outer conductor AL, depending upon the switching state. One can thus switch back and forth between two different dispersion relations. For example, for a given frequency, the TEM mode can be switched between propagatable and evanescent. Compared to state-of-the-art PIN diode switches, the diodes in the coaxial conductor structure designed according to the invention need to switch considerably less capacity, since due to the capacitive voltage divider the voltage applied to them is not the total voltage. Alternatively or in combination, switchable components can also be provided between the inner conductor IL and the respective ring structures R. In the embodiment illustrated in FIG. 8, the ring structure R is connected with the inner conductor IL via a local electrical connection EV, wherein the spatial orientation of the pin-shaped electrical connections EV between two adjacent ring structures R changes by 90°. It is also possible to fit a switchable component WS' alternatively or in combination between two longitudinally adjacent rings R, preferably in the form of a diode in series direction, in contrast to the shunt diodes marked WS.

Another way of influencing the dispersion properties of the coaxial conductor structure designed according to the invention with regard to the progression or propagation behavior of the TEM modes is via the capacitive coupling of two adjacently arranged ring structures. Tests in this respect have shown that the higher the capacity is between two adjacent ring structures, the more advantageous are the effects formed with regard to a substantially interference-free propagation at least with respect to the TEM basic mode.

Figure 9:
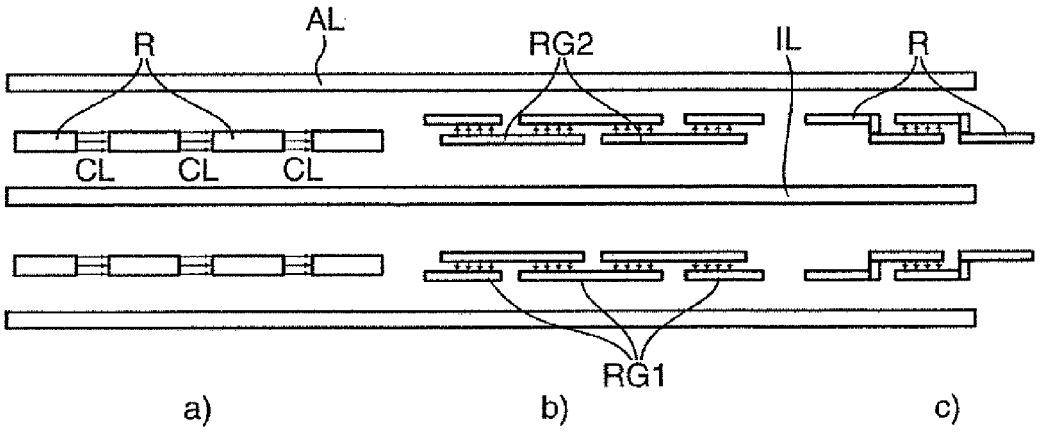
FIGS. 9*a, b* and *c* respectively are alternative implementations comprising higher-capacitance coupled ring structures.

In order to choose a maximum coupling capacity CL, FIGS. 9 *a, b* and *c* show three alternative measures for designing the ring structures R fitted, respectively, between the inner conductor IL and the outer conductor AL of a coaxial conductor structure. In case a) the ring structures R shaped as conventional rings comprise a ring thickness which has been chosen to be as large as possible in order to achieve a maximum real size for the axially opposing ring faces. In case b) two groups of ring structures RG1, RG2 have been provided, which differ from each other as regards their ring diameter. The ring structures RG1 and RG2 of both groups are each arranged with an axial overlap in the shape shown in FIG. 9*b*. In this case also, the area between two adjacent ring structures (see arrow symbols) effective capacity which is enlarged. In case c), the axial overlap of two adjacent ring structures R is utilized. In this case the ring structures R comprise an axially step-shaped ring longitudinal section thereby permitting mutual overlapping in axial direction.

Figure 10:
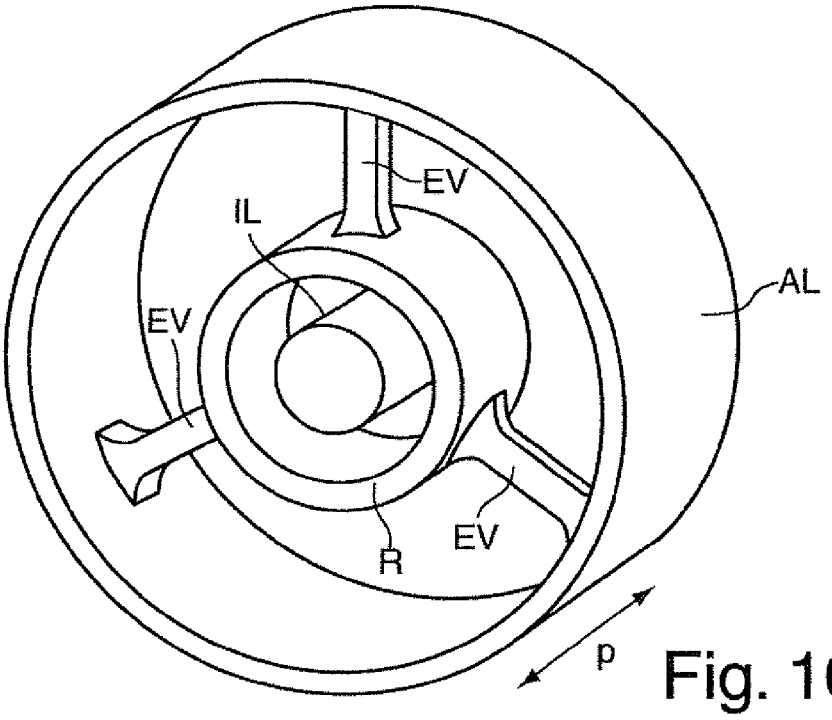
FIG. 10 is an elementary cell with three spokes for realizing a low-pass filter.

FIG. 10 shows an elementary cell of a coaxial conductor structure shaped according to the invention in a perspective view with a spaced apart ring structure R arranged between the inner conductor IL and outer conductor AL. The radial distance to the inner conductor IL is dimensioned to be smaller than that to outer conductor AL. The ring structure R in the illustrated embodiment is connected with the outer conductor AL via three electrically conducting connecting webs EV, which so-called "spokes". The spokes EV are arranged to be evenly distributed in circumferential direction about the inner conductor IL. Each of the spokes EV represents a shunt inductivity and substantially impacts the propagation behavior of the TEM mode along a coaxial line which is characterized by multiple elementary cells arranged axially one behind the other, as shown in FIG. 10.

Figure 2A:
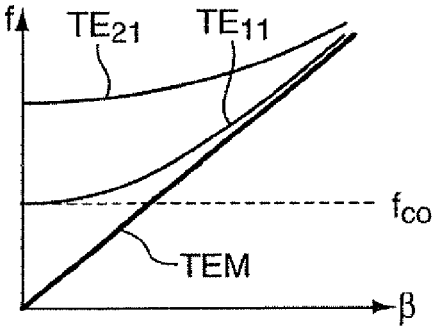
FIGS. 2*a* and *b* respectively are a dispersion diagram of a conventional coaxial line and a coaxial conductor structure shaped according to the invention.
Figure 2B:
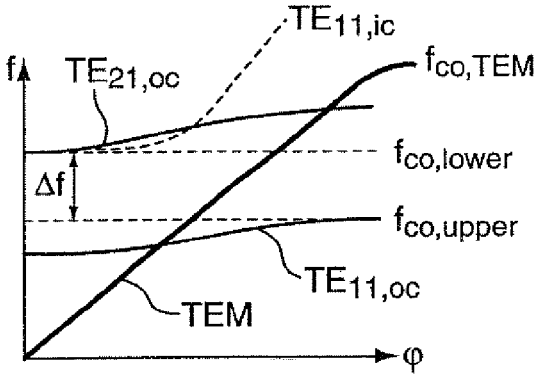
Figure 11:
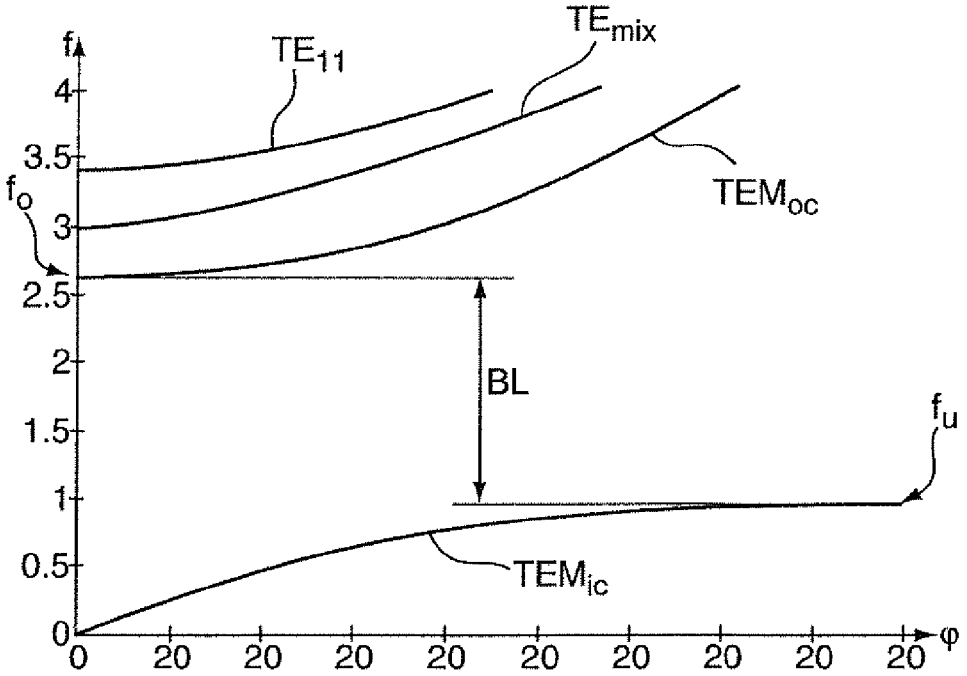
FIG. 11 is a dispersion diagram for illustrating a low-pass filter.

The type of impact upon the propagation behavior of the TEM mode is revealed in the dispersion diagram shown in FIG. 11, which is similar to the dispersion diagram in FIG. 2*b* illustrating the connection $\omega(\Phi)$, wherein $\phi=\beta p$ is the phase difference of the respective wave along an elementary cell of length p. Let it be assumed that in this case also the length of the elementary cell is p.

It is evident that the TEM mode, in contrast to the speed-of-light straight, as is the case in FIGS. 2*a* and *b*, splits into 3 modes, with one mode corresponding to a TEM mode portion $TEM_{ic}$ propagating essentially within the inner propagation channel between inner conductor IL and ring structure R, another mode corresponding to a TEM mode portion $TEM_{oc}$ propagating essentially within the outer propagation channel between the ring structure R and outer conductor AL, and a third propagation branch corresponding to a TEM mode $TEM_{mix}$ propagating in both propagating channels with respectively anti-parallel E-field orientations.

The consequence of this splitting is that it leads to a band gap BL within which none of the TEM mode portions $TEM_{ic}$, $TEM_{oc}$ and $TEM_{mix}$ is propagatable. As such the band gap BL in the depicted case is limited by an upper and a lower cut-off frequency fo and fu, to which the following relationships apply:

$$f_0 = f_{min}\left(\begin{array}{c} f_{TEM,oc} \approx \dfrac{1}{2\pi\sqrt{C_{oc}L_{shunt}}}; \\ f_{TEM,mix} \approx \dfrac{c}{2p}; \\ f_{TE11,ic} = \dfrac{2c}{\pi(d_2+d_1)} \end{array}\right);$$

$$f_u \approx \frac{1}{2\pi\sqrt{(C_{ic}+C_{oc})L_{shunt}}}$$

with $$L_{shunt,3Speichen} = 0.3023\frac{\mu}{2\pi}l\ln\left(0.2166\frac{d_4}{r} - 0.2585\frac{l}{r} - 0.4744\right)$$

$$C_{ic} = \frac{2\pi\varepsilon p}{\ln\frac{d_2}{d_1}}$$

$$C_{oc} = \frac{2\pi\varepsilon p}{\ln\frac{d_4}{d_3}}$$

$L_{shunt}$: overall inductivity of the electrically conducting connecting webs, so-called spokes, for a triple spoke arrangement, $C_{ic}$: capacity between ring and inner conductor, $C_{oc}$: capacity between ring and outer conductor, C: speed of light, μ: permeability, ∈: permittivity, p: length of cell, a: ring distance, l: length of spokes [for AL ring spokes 1=(d4−d3)/2],
r: an effective spoke radius The occurrence of such a band gap BL represents a kind of blocking area for the propagation behavior of the TEM mode, which is caused by the electrically conducting spokes EV between ring R and outer conductor AL, that can be utilized as a low-pass filter arrangement. It is of course possible to adapt the spectral position of the band gap and also its spectral width to the respective technical requirements by a suitable choice regarding number, arrangement, form and size of the spokes EV and also of the ring arrangement between the inner and outer conductor in an optimizing way.

Figure 12:
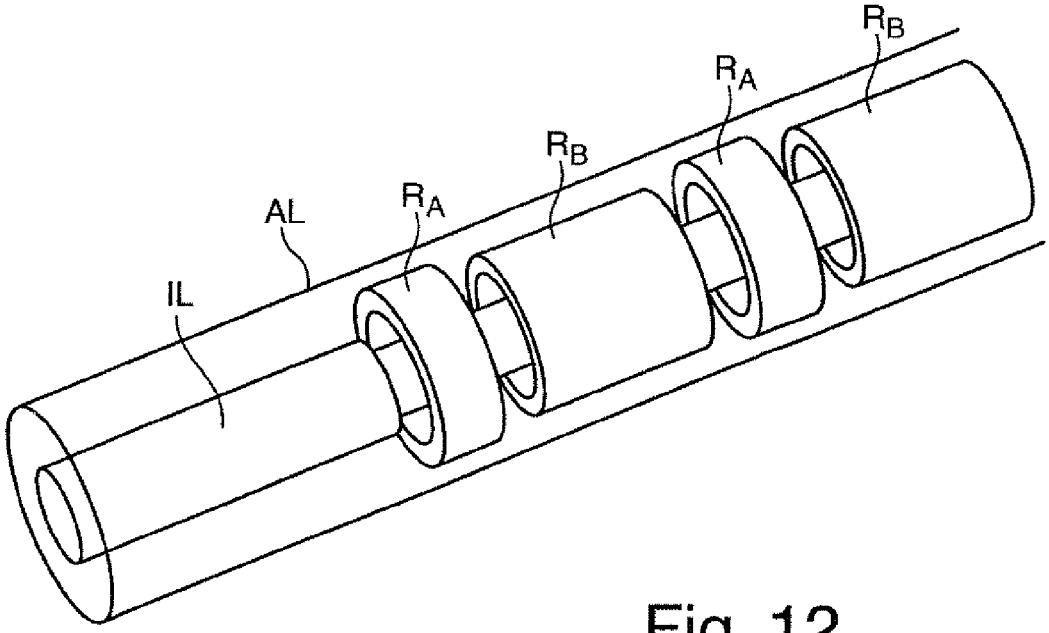
FIG. 12 is a longitudinal section through a coaxial conductor structure with bi-periodical ring structure arrangement.

FIG. 12 shows an embodiment for a coaxial conductor structure with ring structures $R_A$ and $R_B$ arranged between inner conductor IL and outer conductor AL, which can be divided into two groups regarding their form and size. The respectively structurally identical ring structures $R_A$, in the example illustrated, comprise half the axial length of the respectively structurally identical ring structures $R_B$. Due to their bi-periodic arrangement, that is $R_A$, $R_B$, $R_A$, $R_B$, $R_A$ and $R_B$, etc. axially along the coaxial conductor structure the transmission quality of RF signals along the coaxial conductor structure can be improved.

LIST OF REFERENCE SYMBOLS

AL outer conductor
DA dielectric spacer
EV electrical connection
IL inner conductor
LA common conductor section
R ring-shaped structure, ring structure
R1, R2, R3, R4 and R5 rings
$R_u$ and $R_o$ ring segments
ST spacer discs
VL connecting line
WS switchable component
WS' switchable component
BL band gap

The invention claimed is:

1. A coaxial conductor structure for interference-free transmission of a TEM Mode of a HF signal wave within at least one band of frequency bands forming a dispersion relation comprising:

an inner conductor and an outer conductor which is spaced radially apart from the inner conductor;

an axially extending common conductor section of the inner and the outer conductor, including a number n≥3 of electrically conductive ring-shaped structures, wherein each electrically conductive ring-shaped structure is disposed between the inner and the outer conductors, is radially spaced apart from both the inner and the outer conductors, provides an electrical path completely surrounding the inner conductor, the electrically conductive ring-shaped structures are disposed along the conductor section in a spatially separated periodic sequence providing equal spacing between each two adjacent electrically conductive ring-shaped structures and including a capacitive coupling between each two adjacent electrically conductive ring-shaped structures;

the electrically conductive ring-shaped structures having an inner diameter which is greater than an outer diameter of the inner conductor;

the electrically conductive ring-shaped structures each having an outer diameter which is smaller than an inner diameter of the outer conductor;

the electrically conductive ring-shaped structures limiting an inner propagation channel to be between the inner conductor and the ring-shaped structures and an outer propagation channel to be between the ring-shaped structures and the outer conductor; and at least one of the electrically conductive ring-shaped structures is electrically connected with at least one of the inner and the outer conductors by a metallic conductor either in contact with the outer conductor and at least one ring-shaped structure or is in contact with the inner conductor and at least one ring-shaped structure or a switchable component is electrically connected to at least one of the ring-shaped structures and electrically connected to at least one of the inner and the outer conductors or is electrically connected to two electrically conductive ring-shaped structures adjacent to each other in a longitudinal direction.

2. The coaxial conductor structure according to claim 1, wherein:

the ring-shaped structures comprise rings concentrically arranged between the inner and outer conductors of the coaxial conductor so that a larger extension of the rings is in a longitudinal direction than in a radial direction of a common conductor section or the ring-shaped structures comprise discs having a larger radial extension than in longitudinal direction of the common conductor section.

3. The coaxial conductor structure according to claim 1, wherein:

at least two ring-shaped structures are adjacently disposed in a longitudinal direction and partially overlap in the longitudinal direction.

4. The coaxial conductor structure according to claim 1, wherein:

the ring-shaped structures comprise first and second groups which differ in at least one of size and shaping and are axially arranged in a longitudinal direction of the axially extending common conductor section to be alternately from the first group and from the second group.

5. The coaxial conductor structure according to claim 1 comprising a switch for switching RF power.

6. A coaxial conductor structure according to claim 1 comprising a low-pass filter.

7. A coaxial conductor structure in accordance with claim 6 comprising:

at least one electrically conducting connecting web disposed between the ring and the outer conductor for locally electrically short-circuiting the electrically conductive ring-shaped structures to the outer conductor.

8. A coaxial conductor structure in accordance with claim 6 comprising:

at least two electrically conducting connecting webs disposed equidistantly around the inner conductor.

9. The coaxial conductor structure according to claim 1 wherein the switchable component is a diode or a varactor.

* * * * *